United States Patent [19]

Prevot et al.

[11] Patent Number: 4,964,660

[45] Date of Patent: Oct. 23, 1990

[54] LOCKING DEVICE INCLUDING LOCKING, POSITIONING, AND SEALING MECHANISMS

[75] Inventors: M. Gérard Prevot, Willerwald; M. Laurent Aumercier, Phalsbourg; M. Philippe Simoncelli, Hoff, all of France

[73] Assignee: Ferco International Usine de Ferrures de Batiment, Sarrebourg, France

[21] Appl. No.: 363,685

[22] Filed: Jun. 9, 1989

[30] Foreign Application Priority Data

Jun. 20, 1988 [FR] France ..... 88 08418

[51] Int. Cl.[5] ..... E05C 1/06

[52] U.S. Cl. ..... 292/37; 292/DIG. 51; 292/DIG. 55; 292/DIG. 39

[58] Field of Search ..... 292/DIG. 51, DIG. 55, 292/37, 144, DIG. 39, 8, 34, 32; 70/118, 113

[56] References Cited

U.S. PATENT DOCUMENTS

| | | | |
|---|---|---|---|
| 819,460 | 5/1906 | Rooney | 292/37 |
| 928,905 | 7/1909 | Cottrell | 292/37 |
| 1,579,619 | 4/1926 | Kerby | 292/DIG. 55 |
| 1,654,163 | 12/1927 | Evans | 292/DIG. 55 |
| 1,768,459 | 6/1930 | Wells | 292/DIG. 39 |
| 3,789,633 | 2/1974 | Crepinsek | 292/34 X |
| 3,922,925 | 12/1975 | Takei et al. | 292/34 X |
| 4,192,535 | 3/1980 | Picard | 292/37 |
| 4,391,460 | 7/1983 | Bonet | 292/37 |
| 4,432,573 | 2/1984 | Goldman | 292/37 |
| 4,470,277 | 9/1984 | Uyeda | 70/118 |
| 4,573,720 | 3/1986 | Nicolai | 292/144 |
| 4,579,376 | 4/1986 | Charlton | 292/144 |
| 4,594,865 | 6/1986 | Parcell | 292/32 X |
| 4,677,834 | 7/1987 | Hicks | 292/144 |
| 4,683,733 | 8/1987 | Marin | 292/8 X |

FOREIGN PATENT DOCUMENTS

| | | | |
|---|---|---|---|
| 3505379 | 10/1986 | Fed. Rep. of Germany | 292/37 |

*Primary Examiner*—Eric K. Nicholson

*Attorney, Agent, or Firm*—Sandler, Greenblum & Bernstein

[57] ABSTRACT

A device for improving the safety and air tightness of doors, casement windows, or the like and is applicable to casement locks, casement bolts, multi-bolt locks, or the like. The device comprises in combination a dead bolt and a mechanism for positioning and urging the leaf of the door, window or the like against its dormant frame. The positioning mechanism and the dead bolt are actuated sequentially by a control member such as a control rod cooperating with the control mechanism of the casement bolt, casement lock, multi-bolt lock or the like.

11 Claims, 2 Drawing Sheets

LOCKING DEVICE INCLUDING LOCKING, POSITIONING, AND SEALING MECHANISMS

BACKGROUND OF THE INVENTION

1. Field of the Invention

The present relates to locking means applicable to casement-bolts, casement-locks, multi-bolt locks or the like for doors, casement windows or the like.

This invention is applicable to the field of house hardware.

2. The Prior Art

Many types of locking devices of the multi-bolt types are already known which permit of locking the leaf of a door, casement window or the like with respect to its dormant frame, at several levels.

Among these locking fittings one particular type usually referred to as a casement bolt consists of one or a plurality of rods actuated by means of a central mechanism secured to the leaf and actuated by the user by means of a handle. These rods are provided with locking leans such as rollers, adapted to engage keepers formed at the corresponding levels on the fixed frame.

This combination, at several levels of the door, window or the like, of rollers with keepers having a specific configuration causes the movable leaf to be pressed with a certain force against the frame while simultaneously pressing against each other the gaskets disposed at the periphery of the fixed and movable elements. Thus, a reliable air-tightness is obtained between the door, window or the like and its frame.

However, the degree of safety afforded by these known casement bolts is relatively moderate. In fact, when a locking force is exerted directly on the locking members, for instance on said rollers, as would be the case if a burglar attempted to break in from outside, the door, window or the like would be unlocked quite easily with respect to its frame.

To avoid this inconvenience, combination casement lockbolts have been developed in which the notion of lock and therefore of safety is combined with the casement lock structures mentioned hereinabove. More particularly, these casement locks comprise a mechanism incorporating a lock bolt proper actuated by a key member of which the function is to lock the control rods in their locking position. It is also known to provide these casement locks with a half-turn bolt permitting for example of closing a door without necessarily locking this door. Similarly, the locking bolt may also, in addition to the above-defined function, constitute a central locking point of the door, window or the like, by acting also as a dead lock.

Though casement locks permit of easily avoiding the shortcomings of the simple casement bolt, it is admitted that their degree of safety is still insufficient.

In fact, it should be emphasized that casement locks as a rule are fitted in the lock or front stile of the door or window, the actuating rods being slidably mounted in a groove behind a face plate secured to the door edge. This arrangement is objectionable in that it impairs appreciably and locally the strength of the door or casement window which, under these conditions, would oppose but a weak resistance in case a shock corresponding for example to the impact of a club were applied thereto.

The prior art solution brought to this problem of mechanical strength consisted in fitting the casement-locks in section members secured to the inner side of the leaf. The same solution was also applied to the keepers usually fitted in the edge of the dormant frame, thus increasing the fragility of the door, window or the like. Consequently, these keepers have been embedded in strips or section members secured to the front stile of the dormant frame, at the level of the locking members of the casement-lock. In order to further improve the mechanical strength of the assembly and, eventually, the degree of safety of the locking means of a door, window or the like, the various mechanical component elements, notably the actuating rods having a bar-like configuration, have been reinforced. Moreover, dormant keepers movable at right angles to said front stile have been substituted for the rollers moving parallel to the front stile. This modification led to the multi-bolt lock. Indisputably, these dormant keepers, due to their greater strength in comparison with the rollers, increase considerably the safety of said multi-bolt locks. However, this improved safety was obtained at the expenses of the air-tightness of the door, window or the like. In fact, as a consequence of the play existing between the leaf and the frame, the keepers had to be fitted quite loosely in relation to the dead bolts to permit the engagement of said keepers. Consequently, with this arrangement it is definitely precluded to cause the leaf to exert a pressure against its frame when locking the door, window or the like.

SUMMARY OF THE INVENTION

It is the primary object of this invention to avoid the above-mentioned inconveniences by providing means for combining the safety and tightness of a door, window or the like. The present invention, as characterized in the appended claims, provides a solution to the problem consisting in creating a locking system applicable to casement bolts, multi-bolt locks or the like, which comprises, in combination, a dead bolt and means for positioning the leaf of the door, casement window or the like with respect to the dormant frame, said means and said dead bolt being actuated sequentially by a control member such as an actuating rod co-operating with the control mechanism of the casement bolt, casement lock, multi-bolt lock or the like.

The advantages resulting from the present invention consist essentially in that the locking means improve not only the locking safety of multi-bolt locks but also the reliability of the air-tightness of a door, window or the like to which said means are applied. However, this result is obtained without resorting to any additional actuation of the mechanism controlling said locking means, or to a greater effort to be exerted by the user for actuating the various rods controlling the locking means.

The invention will be better understood as the following description of a typical form of embodiment thereof proceeds with reference to the attached drawings.

THE DRAWINGS

FIG. 1 is a diagrammatical elevational and part-sectional view of the improved locking means of the present invention, FIG. 2 is a diagrammatic section taken in the direction of the arrows 2—2 of FIG. 1, and FIG. 3 is a diagrammatic view showing a door to which a multi-bolt lock is fitted.

DESCRIPTION OF THE PREFERRED EMBODIMENT

Figure 1:
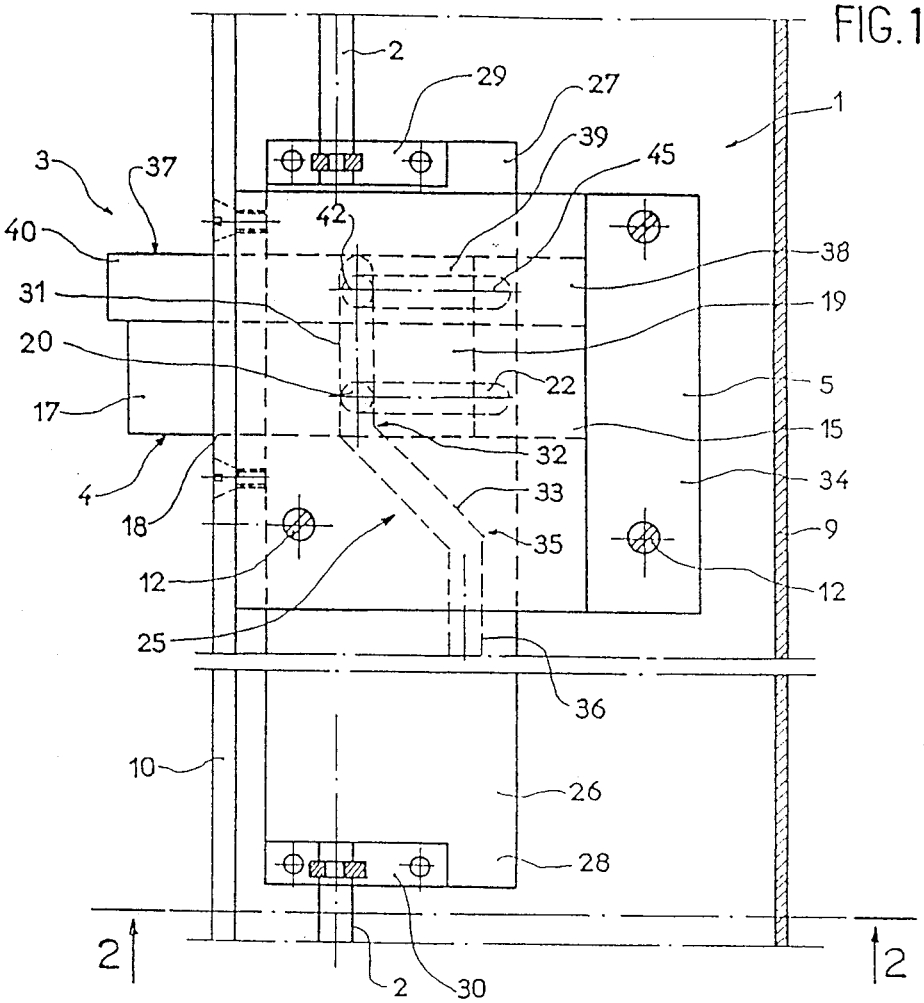

The present invention relates to a lock 1 applicable to locking fittings 50 such as casement-bolts, casement-locks, multi-bolt locks or the like for doors, casement windows or the like.

As a rule, these locking fittings comprise a case either fitted in a cavity formed on the front edge of the leaf, or secured against the inner face of the leaf and adapted to house a control mechanism actuated by the user by means of a control handle or a key.

In fact, this control mechanism (not shown in the Figures) makes it possible to actuate, inter alia, one or a plurality of control rods 2 extending upwards and/or downwards from the lock case and acting upon bolt means 1 adapted to engage keepers disposed at the corresponding levels on the dormant frame 51 of the door, window or the like.

Advantageously, and according to a specific feature of this invention, these bolt means 1 comprise in combination means 3 for properly positioning the leaf of the door, window or the like against its dormant frame, and a dead bolt 4 which, by engaging the registering keeper 52 disposed on said dormant frame, constitutes a locking point affording a higher degree of safety.

Though safety is the essential property and purpose of a locking mechanism, it is inasmuch important to obtain, by means of this mechanism, a satisfactory air-tightness of the door, window or the like to which it is fitted.

This double requirement is met according to this invention by associating a dead bolt, of which the advantageous features are mentioned hereinabove, with positioning means 3. In fact, these positioning means 3 are so constructed that in actual practice it is possible to cause the leaf to exert a pressure against its dormant frame and eventually compress the peripheral gaskets or seals disposed on this frame.

Preferably, these positioning means 3 are actuated before the dead bolt 4. Actuating the positioning means 3 permits of moving this dead bolt 4 back to the level of the corresponding keeper and preventing undesired play from developing therebetween.

Figure 2:
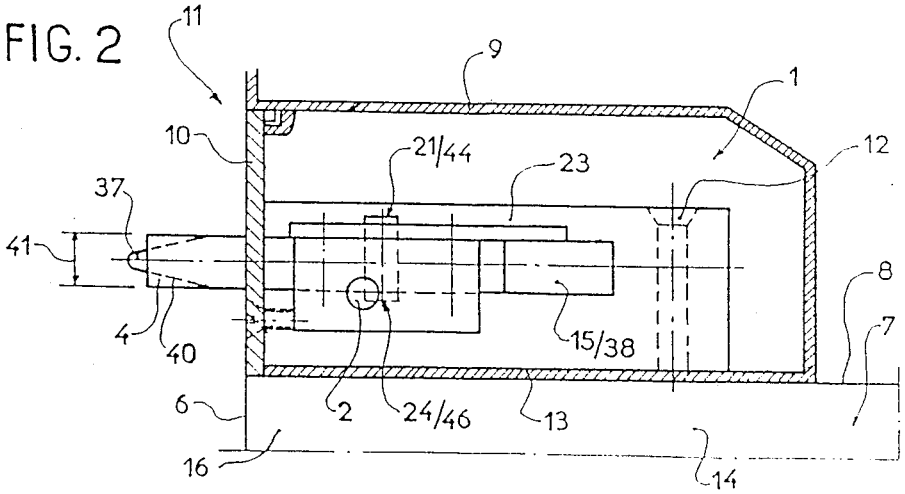

Thus, according to a preferred form of embodiment of the present invention, shown diagrammatically in FIGS. 1 and 2 of the drawings, the locking means 1 comprise a case 5 fitted either in a cavity formed in the front edge 6 of leaf 7, or against the inner side 8 of this leaf. In this last instance, the case 5 is fitted in a section member 9 extending substantially throughout the height of the leaf 7 and covering and concealing all the component elements of the locking assembly.

This case 5 is secured on the other hand to a face plate 10 closing the front portion 11 of section member 9, or covering the groove formed in the front edge 6 of leaf 7. Complementary fastening members 12 co-operating with a protection plate 13 or simply with the inner wall 14 of leaf 7 facilitate the fitting of this locking assembly 1 while improving its mechanical strength in case a burglar attempted to break the door or window open.

Formed in this case 5 is a first cavity 15 corresponding to the parallelipipedic dimensions of dead bolt 4 so as to guide this bolt in mutual sliding contact with the walls of cavity 15, in a direction perpendicular to the front stile 16 of leaf 7 and parallel to the plane of this leaf.

More particularly, the dead bolt 4 comprises a front portion 17 adapted to project from section member 9 through an aperture 18 formed in face plate 10. Furthermore, it comprises a body 19 of same cross-sectional configuration as the first cavity 15. This body 19 is responsive to said control rod 2 actuated by the lock control mechanism so as to move the dead bolt 4 either to its retracted position or to its projecting, operative position.

For this purpose, a pin 20 extends through the body 19 of this bolt. One projecting end 21 of said pin 20 engages an elongated groove or cavity 22 extending horizontally in the inner wall 23 of case 5, and the opposite projecting end 24 of pin 20 engages an aperture 25 machined in a bridge member 26. This bridge member 26 extends vertically through the case 5 and has its upper and/or lower ends 27, 28 fastened by means of suitable means 29, 30 to control rod 2.

Advantageously, the aperture 25 machined in bridge member 26 comprises a first vertical section 31 opening at its lower end 32 into an oblique section 33 inclined towards the rear portion 34 of case 5. This oblique section 33 of aperture 25 opens in turn, at its lower portion 35, into a second vertical section 36.

Thus, in the locking position illustrated in FIG. 1, the dead bolt 4 projects from face plate 10 and the projecting end 24 of pin 20 engages the vertical section 31 of aperture 25 formed in bridge member 26. It will be seen that this vertical section 31 is nearer to face plate 10 than the other vertical section 36.

When the control rod 2 is actuated, the bridge member 26 is moved upwards, the projecting end 24 of pin 20 rises along the oblique section 33 and therefore its movement has a horizontal component causing the dead bolt 4 to recede. This bolt 4 is retracted completely with respect to face plate 10 when the projecting end 24 of pin 20 engages the second or lower vertical section 36 of aperture 25. During these movements, the other projecting end 21 of pin 20 moves along the elongated groove or aperture 22.

Furthermore, the means 3 for positioning the leaf 7 with respect to its dormant frame consists advantageously of a take-up bolt 37 housed in case 5 and overlying the dead bolt 4.

For this purpose, the case 5 is provided with another recess 38 overlying the cavity 15 and constituting a vertical extension thereof, capable of receiving the dead bolt 4. The body 39 of said take-up bolt 37 is slidably fitted in said upper recess 38. The specific feature characterizing this take-up bolt 37 is its tapering front end 40 adapted to project from face plate 10 through the aperture 18 of which the dimensions are increased accordingly.

Figure 3:
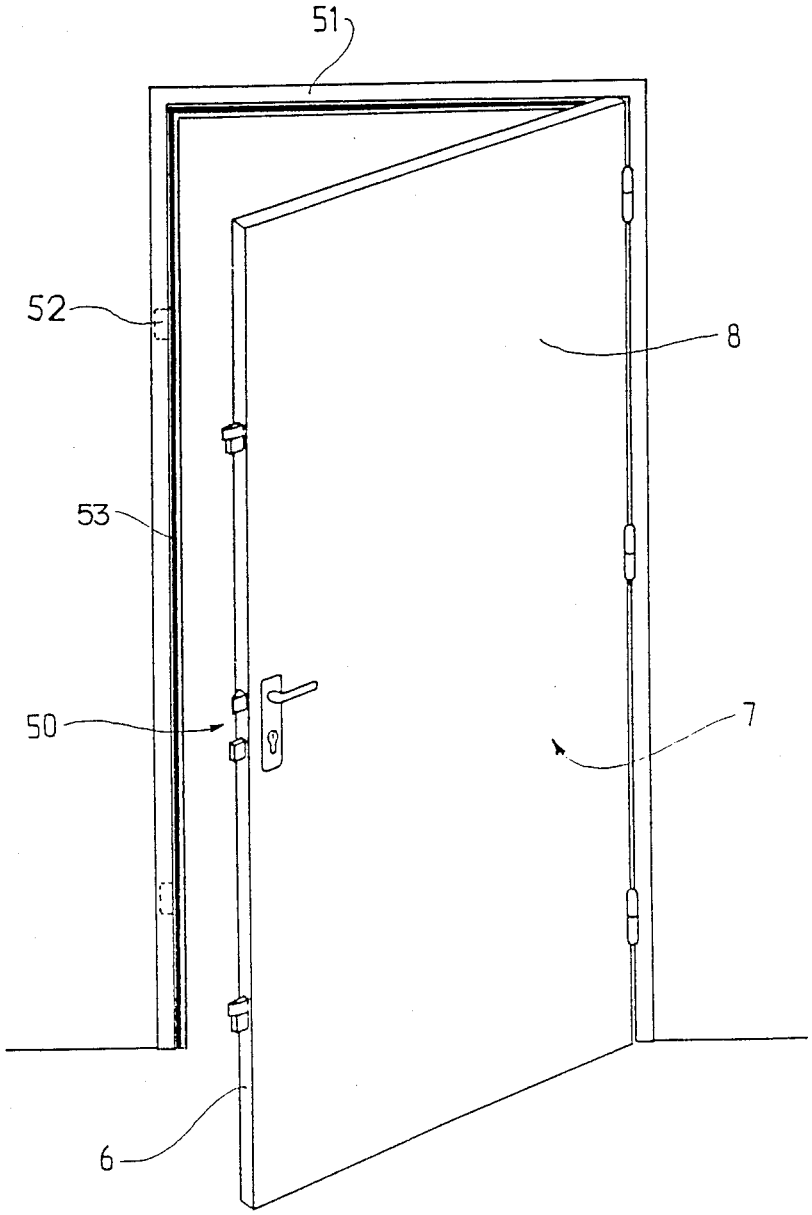

More particularly, when controlling the locking system, the gradual penetration of this tapered front portion 40 of take-up bolt 37 into the corresponding keeper 52 provided on the dormant frame will on the one hand take up the play existing between this frame and the lead and, eventually, compress the peripheral gaskets or seals 53 (FIG. 3) of the door, window or the like, so as to warrant the air-tightness of the joint.

As already mentioned hereinabove, the take-up bolt 37 and dead bolt 4 of locking member 1 are actuated sequentially and in this order. Thus, due to the action exerted by take-up bolt 37 on leaf 7, the dead bolt 4, when actuated, will compulsorily register with the corresponding keeper 52. Therefore, this keeper 52 can be adjusted substantially without any excessive clearance with respect to the dead bolt 4.

Preferably, according to a specific feature of the present invention, the keeper disposed on the dormant frame and registering with the locking means 1 is common to the dead bolt 4 and to the take-up bolt 37. These two bolts 4 and 37 have the same thickness 41. With this arrangement, the play existing between the various locking component elements constituting the dead bolt 4 and take-up bolt 37, on the one hand, and said keeper, on the other hand, is minimized.

The means controlling the take-up bolt 37 when actuating the control rod 2 are based on the same principle as the dead bolt 4. Thus, a pin 42 extends through the body 39 of take-up bolt 37. One of the projecting ends 44 of this pin 42 engages a horizontal groove or aperture 45 machined in the inner wall 13 of case 5, and the other projecting end 46 engages the aperture formed in bridge member 26. As clearly shown in FIG. 1, when the take-up bolt 37 is disposed above the dead bolt 4, the projecting end 46 of pin 42 follows in groove 25 the same path as that followed by the projecting end 24 of pin 20 in aperture 25. However, this movement of pins 42 and 20 takes place with a difference resulting from their respective positions in case 5.

Thus, during the unlocking phase and considering the component elements in their initial positions as shown in FIG. 1, the projecting end 24 of pin 20 engages firstly the oblique section 33 of aperture 25, thus causing initially the backward movement of dead bolt 4, followed by the retraction of take-up bolt 37.

In contrast thereto, during the locking phase, when control rod 2 is actuated, the movements of pins 20, 42 with respect to aperture 25 in bridge member 26 and in the grooves or elongated apertures 22 and 45, are inverted. Thus, during a first step, the take-up bolt 37 engages the keeper provided on the dormant frame, and then the dead bolt 4 is moved forwards. It is essential that the dead bolt 4 cooperates with said keeper only in case the take-up bolt 37 has reached its outermost position, so that the leaf can engage the dormant frame with the necessary pressure. Under these conditions, a possible faulty operation of the locking system in case the dead bolt 4 did not register with the keeper during the unlocking movement is safely avoided.

It will be seen that no additional source of power is required for controlling the locking system 1 of the present invention, in comparison with hitherto known locking systems. In fact, due to its particular construction, the movements of dead bolt 4 and take-up bolt 37 are split in time and prevent the addition of the forces required for producing these movements.

More particularly and in addition, the work required for actuating one or the other of said dead bolt 4 and take-up bolt 37 is the same as that corresponding to the actuation of the dead bolts of so-called multi-bolt locks. In fact, it is the object of the present invention to improve on the one hand the air-tightness of doors, windows or the like, and on the other hand the safety of the locking means, without increasing the stroke or length of movement of one of the locking members of this dead bolt across the dormant frame. This additional stroke or movement would either require a greater width of section member 9 and also a longer stroke of control rod 2, or imply a greater resistance of the control handle actuated by the user.

With this combination of two separate locking members for positioning the leaf with respect to the dormant, the improved safety of the locking member permits inter alia of avoiding an increment in manufacturing costs.

More particularly, the dead bolt 4 requiring in this case only a small number of machining operations can be made of special, high-strength material, thus improving the safety of locking means 1. Finally, the take-up bolt 37 can be made preferably of mild steel permitting the machining of its tapered end portion 40 by using conventional tools.

What is claimed is:

1. A locking device for locking a movable member with respect to a frame member, said locking device comprising in combination a dead bolt adapted to be supported by the movable member for movement between an extended position and a retracted position with respect to the movable member, means for moving said dead bolt between said positions, said extended position comprising engaging said dead bolt with a correspondingly positioned aperture in the frame member, means for positioning the movable member with respect to the frame member, said means for positioning adapted to be supported for movement by the movable member between extended and retracted positions with respect to the frame member, means for moving said positioning means between said positions, said extended position engaging said means for positioning with a correspondingly positioned aperture in the frame member, and means for sequentially actuating said dead bolt and said means for positioning for movement between said extended and retracted positions.

2. The locking device according to claim 1, wherein said means for sequentially actuating comprises a control rod.

3. The locking device according to claim 2, wherein the movable member comprises a generally planar surface having a face plate substantially perpendicular to the planar surface and a case secured to the face plate, said case comprising means housing said positioning means and said dead bolt.

4. The locking device according to claim 2, the movable member comprising a generally planar surface having a face plate substantially perpendicular to the planar surface and a case, said case defining a cavity comprising means receiving and guiding said dead bolt for movement in a direction perpendicular to the face plate and parallel to the planar surface.

5. A locking device according to claim 4, wherein said dead bolt comprises a front portion adapted to project, when in said extended position, from the face plate through an aperture in the face plate, and a body portion slidably positioned within the cavity of said case, said body of said dead bolt being operatively coupled to said control rod.

6. A locking device according to claim 4, wherein said case comprises at least one wall, said dead bolt comprises a body slidably positioned within the cavity of said case, a pin extending through said dead bolt body, one end of said pin engaged in a first elongated groove provided in said wall of said case, the opposite end of said pin engaging a second elongated groove provided in a bridge member, said second groove extending perpendicularly to said first groove, said bridge member connected to said control rod.

7. A locking device according to claim 2, said movable member comprising a generally planar surface having a face plate substantially perpendicular to the planar surface and a case, an elastic gasket positioned about the periphery of one of said members, said case defining a cavity containing said positioning means for said movable member, said positioning means comprising a take-up bolt slidably received in said case adjacent said dead bolt, said take-up bolt comprising a body portion and a tapered front portion, said tapered front portion adapted to engage, in the extended position, a keeper on said frame member for taking up play existing between the members and for compressing said gasket.

8. A locking device according to claim 7, wherein said case further comprises a recess constituting an extension of the cavity receiving said dead bolt, said take-up bolt body slidably positioned within the recess.

9. The locking device according to claim 7, said case defined by at least one wall, said take-up bolt body includes a pin extending through said body, one projecting end of said pin engaging a first groove formed in said case wall, the other projecting end of said pin engaging a second groove formed in a bridge member extending through said case, said bridge member operably connected to said control rod.

10. A locking device according to claim 2, said movable member comprising a generally planar surface having a face plate substantially perpendicular to the planar surface and a case, said case defined by at least one wall, said positioning means comprising a take-up bolt, said take-up bolt and said dead bolt each having a body, a pin extending through each said body, one projecting end of each said pin cooperating with first elongated grooves formed in said case wall, the other end of each said pin engaging a second elongated groove formed in a bridge member, said second groove comprising first and second spaced parallel sections extending transversely to said first grooves, and an oblique section joining said spaced parallel sections.

11. A locking device in accordance with claim 2, said movable member comprising a generally planar surface having a face plate substantially perpendicular to the planar surface and a case, said means for positioning comprising a take-up bolt, said dead bolt and said take-up bolt having a common thickness in a direction transverse to the planar surface, and to the direction of movement between the extended and retracted positions, said dead bolt and said take-up bolt projecting from said base plate through a common aperture, and cooperating with a keeper disposed in alignment with said dead bolt and take-up bolt in the frame member.

* * * * *